United States Patent [19]

Dellinger et al.

[11] Patent Number: 4,749,187

[45] Date of Patent: Jun. 7, 1988

[54] TRACK HURDLE WITH ADJUSTBLE LATCHING MECHANISM AND ADJUSTING WEIGHT MECHANISM

[75] Inventors: William S. Dellinger; Nils A. Norman, both of Eugene, Oreg.

[73] Assignee: Oregon Track Equipment Co., Eugene, Oreg.

[21] Appl. No.: 889,680

[22] Filed: Jul. 28, 1986

[51] Int. Cl.[4] ..... A63B 5/02

[52] U.S. Cl. ..... 272/103

[58] Field of Search ..... 272/103, 72, 100–102; 403/108, 322; 248/337

[56] References Cited

U.S. PATENT DOCUMENTS

| | | | |
|---|---|---|---|
| 1,278,100 | 9/1918 | Bruning | 403/108 |
| 1,910,080 | 5/1933 | Austin | 272/103 |
| 2,474,722 | 6/1949 | Blume | 403/108 |
| 2,583,786 | 1/1952 | Marzucco | 272/103 |
| 2,706,631 | 4/1955 | Holmes | 272/103 |
| 2,718,397 | 9/1955 | Verkuilen | 272/103 |
| 4,390,300 | 6/1983 | Foster | 403/108 |

FOREIGN PATENT DOCUMENTS

| | | | |
|---|---|---|---|
| 125643 | 7/1931 | Fed. Rep. of Germany . | |
| 862797 | 3/1941 | France . | |
| 746740 | 3/1956 | United Kingdom | 272/103 |
| 2163965 | 3/1986 | United Kingdom | 272/72 |

*Primary Examiner*—Richard J. Apley
*Assistant Examiner*—S. R. Crow
*Attorney, Agent, or Firm*—Kolisch, Hartwell & Dickinson

[57] ABSTRACT

The track hurdle of the instant invention includes a base which rests on the ground and which includes a horizontal, hollow foot, and a hurdle bar assembly telescopically mounted on the base. The hurdle includes height-setting means for adjusting the height of a hurdle bar above a track surface and a constant pull-over weight mechanism for maintaining a constant pull-over weight at the top of the hurdle bar, regardless of the height of the hurdle bar above the track surface.

7 Claims, 1 Drawing Sheet

TRACK HURDLE WITH ADJUSTBLE LATCHING MECHANISM AND ADJUSTING WEIGHT MECHANISM

BACKGROUND AND SUMMARY OF THE INVENTION

The instant application relates to a track hurdle and specifically to an adjustable height track hurdle which has a constant pull-over weight regardless of the height of a hurdle bar above a track surface.

A variety of track hurdles are known which include means for adjusting the height of a hurdle bar above a track surface. Additionally, a number of attempts have been made to maintain a constant pull-over weight at the top of a hurdle bar. Although some attempts have been made to combine the features of height adjustability and constant pull-over weight, the known devices are rather awkward to use and have not been equipped with any mechanism for easily and precisely adjusting the pull-over weight once the hurdle has been assembled.

An object of the instant invention is to provide a track hurdle with a constant pull-over weight, as measured at the top of a hurdle bar.

Another object of the invention is to provide a hurdle which incorporates means for adjusting the height of a hurdle bar and which may be easily operated by one person.

Still another object of the instant invention is to provide a track hurdle wherein the pull-over weight may be precisely adjusted once the hurdle is assembled.

A further object of the instant invention is to provide a track hurdle which is relatively simple and inexpensive to construct.

The track hurdle of the instant invention includes a base which rests on the ground and which includes a horizontal hollow foot, and a hurdle bar assembly telescopically mounted on the base. The hurdle includes height-setting means for adjusting the height of a hurdle bar above a track surface and a constant pull-over weight mechanism for maintaining a constant pull-over weight at the top of the hurdle bar, regardless of the height of the hurdle bar above the track surface.

These and other objects and advantages of the invention will be more fully appreciated as the description which follows is read in conjunction with the drawings.

DETAILED DESCRIPTION OF THE PREFERRED EMBODIMENT

Figures 1, 2, 3, 4:
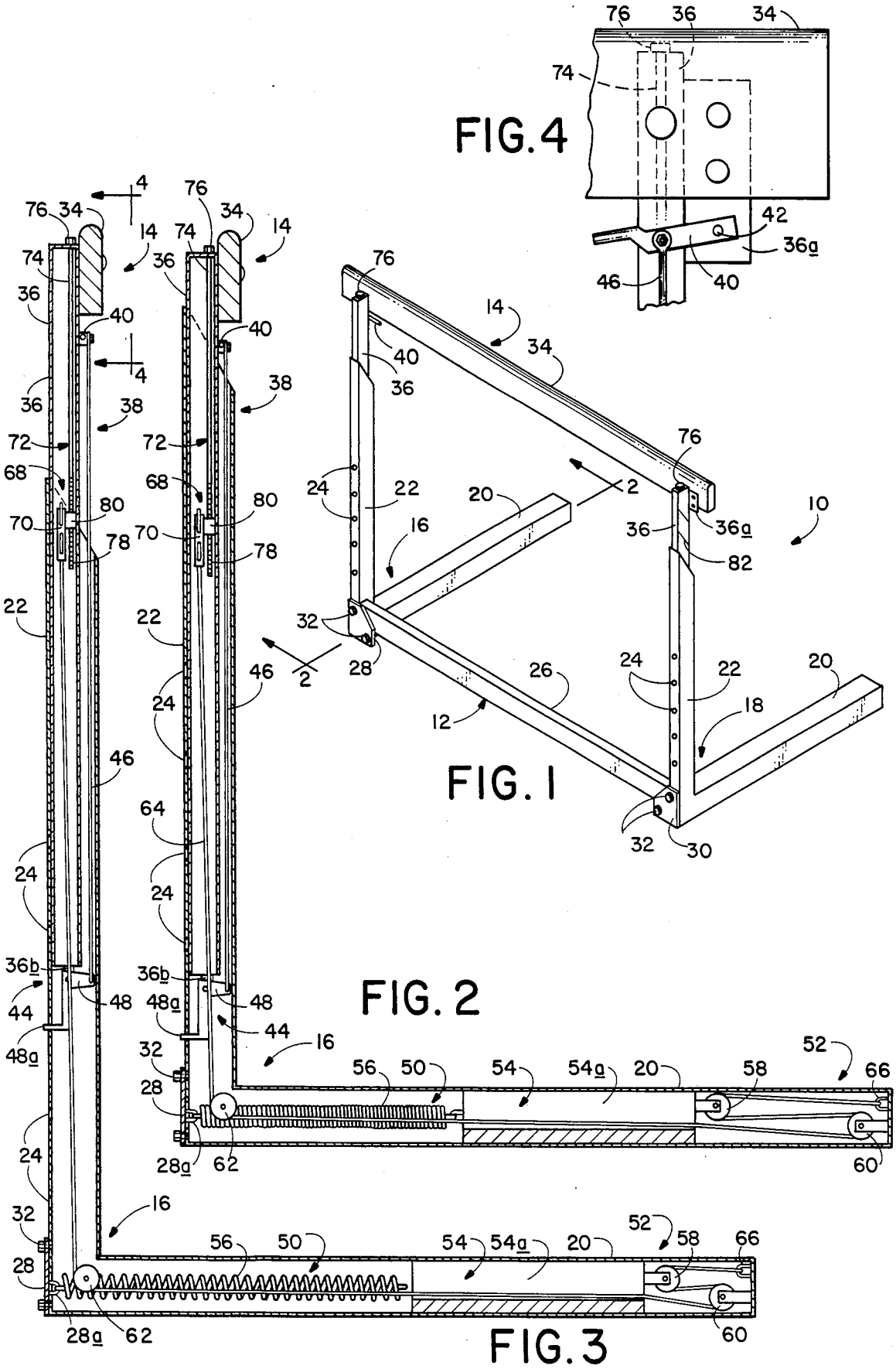
FIG. 1 is a perspective view of a track hurdle constructed according to the invention.
FIG. 2 is a sectional view of the invention, taken generally along the line 2—2 of FIG. 1.
FIG. 3 is a sectional view similar to FIG. 2, with a hurdle bar assembly of the invention in a raised position.
FIG. 4 is a rear plan view of a latch manipulator of the invention, taken generally along the line 4—4 of FIG. 3.

Turning now to the drawings, and initially to FIG. 1, a track hurdle constructed according to the invention is shown generally at 10. Hurdle 10 includes a base, shown generally at 12 and a hurdle bar assembly 14 which is telescopically mounted on base 12.

Base 12 is intended to rest on the ground, which would normally be the surface of a track used for athletic competition. Base 12 includes a pair of spaced apart, hollow tubular standards 16, 18. In the preferred embodiment each standard includes a horizontal portion 20 and a vertical portion 22, arranged in an L-shape. Vertical portions 22 have bores 24 distributed at preselected distances from the bottom thereof, the function of which will be explained later herein.

A cross piece 26 is placed between standards 16 and 18 and rigidly interconnects the standards. Plates 28, 30 cover the forward ends of horizontal portions 20 on standards 16, 18, respectively. Plates 30 are held in place by fasteners, such as fasteners 32.

Hurdle bar assembly 14 includes an elongate, horizontal hurdle bar 34 and a pair of bar supports 36 which are telescopically mounted on vertical portions 22. The bar supports are joined to the hurdle bar adjacent the ends of the hurdle bar.

Referring now to FIG. 2, the internal mechanism of hurdle 10 is shown. Hurdle 10 includes height-setting means, shown generally at 38, which is operable to selectively fix the height of hurdle bar 34 above a track surface. Referring now to FIGS. 2 and 4, height-setting means 38 includes a hand operated latch manipulator 40 which is adjustably mounted on hurdle bar assembly 14. In the preferred embodiment, bar supports 36 have a flange 36*a* affixed to a side thereof. The flange has a pivot pin 42 mounted thereon which in turn retains manipulator 40. Manipulator 40, being pivotally mounted on support 36 adjacent hurdle bar 34 is grippable with the hurdle bar assembly, thereby facilitating adjustment of the hurdle bar height.

A latch mechanism 44 is provided to fix the height of a hurdle bar relative to the standards. In the preferred embodiment, mechanism 44 includes a connecting rod 46 which is pivotally secured to manipulator 40 and extends between manipulator 40 and a latch 48.

Latch 48 is adjustably mounted on support 36 adjacent the base thereof. In the preferred embodiment, support 36 includes a lower flange 36*b* to which latch 48 is secured. Latch 48 includes a latch pin 48*a* which cooperates with bores 24 to hold bar supports 36 at a predetermined height.

Bores 24, also referred to herein as latch retainers or retainer means, are distributed the length of the upright for receiving the latch pin and for locking the hurdle bar assembly in a given position.

Hurdle 10 further includes a constant pull-over weight-setting mechanism, shown generally at 50, for maintaining a constant predetermined pull-over weight at the top of hurdle bar 34. In the preferred embodiment, the hurdle is designed to have a pull-over weight of 8 pounds at the top of bar 34.

Mechanism 50 includes a first adjustable means 52 which is operable to adjust the pull-over weight as the hurdle bar assembly is raised relative to the base. First adjustable means 52 includes a weight 54, having a predetermined mass, which is slidably mounted in base 12 for horizontal movement. In the preferred embodiment, weight 54 is slidably mounted in and for movement along horizontal portion 20, also referred to herein as a hollow foot.

Weight-positioning means are provided to position weight 54 as the hurdle bar assembly is adjusted. Weight-positioning means includes a spring 56, also referred to herein as spring biasing means, which is operable for urging weight 54 in a direction toward the front of foot 20.

Linking means are provided to connect weight 54 to the hurdle bar assembly. In the preferred embodiment, linking means includes a pulley 58 which is mounted on one end of weight 54. A second pulley 60 is attached to the free end of foot 20. A third pulley 62 is located adjacent the juncture of foot 20 and vertical portion 22.

A cable 64 is trained over pulleys 58, 60 and 62 and has one end thereof secured to foot 20, by a connector 66. The other end of cable 64 is fastened to a second adjustable means, shown generally at 68. Weight 54 includes a slot 54*a* which allows passage of cable 64 therethrough.

Second adjustable means 68 includes a cable-retaining means 70 and a cable-adjustment mechanism 72 which is located between the cable-retaining means and bar support 36. In the preferred embodiment the cable-adjustment mechanism comprises a shaft 74 which extends through the top of support 36 and which has a head 76 at one end thereof. The other end of shaft 74 has threads 78 thereon which cooperate with a member 80 having threads conformal to those on shaft 74. Member 80 is secured to cable-retaining means 70, which, in the preferred embodiment, receives the other end of cable 64 through a number of holes therein and which serves to fix the other end of the cable.

The second adjustable means is operable to produce movement of weight 54 without movement of the hurdle bar assembly to "fine tune" the pull-over weight at the top of hurdle bar 34. The weight-positioning means is operable to produce movement of weight 54 against spring 56 with upward movement of the hurdle bar assembly on the base, as depicted in FIG. 4. Conversely, movement of the hurdle bar assembly downward on the base allows movement of the weight with spring 56.

One end of spring 56 is fixed to weight 54 and the other end of the spring is attached to a connector 28*a* which is located on the rear side of plate 28. Similar construction is contained within standard 18. The provisions of plates 28, 30 allow access to the interior of the standard in the event that maintenance is required or to provide lubrication to ensure free movement of weight 54 within foot 20.

To initially set the desired pull-over weight in a hurdle, a measuring device may be attached to the top of hurdle bar 34 in the vicinity of the center of the bar and the pull-over weight adjusted by means of second adjustable means. Shaft 74 may be rotated by means of head 76 to raise cable-retaining means 70, thereby drawing weight 54 rearward in foot 20 and subsequently increasing the pull-over weight. Alternately, rotation of head 76 in the opposite direction will result in lowering cable-retaining means 70 and subsequent movement of weight 54 forward in foot 20. Once the weights in standards 16 and 18 have been properly adjusted, hurdle bar 34 may be raised to a desired height with the operation of weight-positioning means moving weight 54 to a position such that the desired 8 pound pull-over weight will be maintained at the top of hurdle bar 34.

In order to raise or lower the hurdle bar, the bar and manipulators 40 are gripped, thereby moving latch pins 48*a* to their disengaged positions wherein they are free of bores 24. Releasing manipulators 40 allows the latches to move to a position freeing latch pins 48*a* for registering with the appropriate bores. Although in the preferred embodiment, the latch mechanism operates under the influence of gravity, some form of biasing means could be included to assist gravity in maintaining the latch pin in a position where it could register with a bore.

Hash marks 82 are provided on the sides of supports 36 to assist the user in setting the hurdle bar to a desired height. In competition, hurdle bar heights are adjusted, in three inch increments, from a low hurdle height of 30 inches to a high hurdle height of 42 inches or to any standard height therebetween.

In the preferred embodiment, weight 54 has a mass of 6.65 pounds, which, when properly positioned in foot 20 provides a pull-over weight of 8 pounds at the top of hurdle bar 34 as the height of the hurdle bar is adjusted. The movement of weight 54 in foot 20 is 1.5 inches rearward for every 3 inches of upward movement of the hurdle bar assembly.

Thus an adjustable height track hurdle has been disclosed which incorporates a height-setting mechanism enabling easy selection of a predetermined hurdle bar height and a pull-over weight-setting mechanism which maintains a constant pull-over weight regardless of the height of the hurdle bar.

Although a preferred embodiment of the invention has been disclosed, it should be appreciated that variations and modifications may be made thereto without departing from the spirit of the invention.

It is claimed and desired to secure by Letters Patent:

1. In a track hurdle including a base which rests on the ground and which includes a horizontal hollow foot, and a hurdle bar assembly telescopically mounted on said base:

first adjustable means including a weight slidably mounted within and for movement along the hollow foot, biasing means urging said weight in one direction along the foot, and linking means for linking said weight and the hurdle bar assembly whereby movement of the hurdle bar assembly on the base produces movement of said weight along the foot, said linking means including a set of pulleys disposed in the base, and a cable trained over said pulleys, one end of said cable being operatively affixed to said weight; and second adjustable means operatively interposed between the hurdle bar assembly and said linking means and fixed to the other end of said cable for producing movement of said weight along the hollow foot without movement of the hurdle bar assembly.

2. The track hurdle of claim 1 which further includes height-setting means including a latch manipulator and a latch adjustably mounted on said hurdle bar assembly, connecting means connecting said latch manipulator and said latch, and retainer means on said base for receiving the latch to produce locking of said hurdle bar assembly in a desired position relative to the base, said latch manipulator being grippable together with said hurdle bar assembly during lifting of the hurdle bar assembly against said biasing means.

3. A track hurdle comprising:

a base including a pair spaced apart hollow standards, each standard having a substantially vertical portion joined at a right angle to a substantially horizontal portion, and a cross piece rigidly interconnecting said standards;

a hurdle bar;

a pair of hurdle bar supports joined to said hurdle bar, each telescopically mounted on a respective vertical portion for adjusting the height of said hurdle bar;

a constant pull-over weight mechanism for maintaining a constant predetermined pull-over weight at the top of said hurdle bar, said weight mechanism comprising a weight slidably located in each horizontal portion, spring biasing means for urging said weights toward an end of said horizontal portions, and weight-positioning means operatively interposed between each of said weights and its respective hurdle bar support for positioning the weights in said horizontal portions to maintain said predetermined pull-over weight, said weight-positioning means including a cable having one end thereof operatively affixed to said weight and cable-retaining means affixed to the other end of said cable, a set of pulleys disposed in each standard having the cable trained thereover and a cable-adjustment mechanism operatively interposed between said cable-retaining means and said bar support to adjust the position of said weight for a given bar support position thereby to adjust the pull-over weight for a given hurdle bar height; and height-setting means for selectively fixing the height of the hurdle bar above a track, said setting means including a latch adjustably mounted on at least one hurdle bar support, latch retainers distributed along the length of said vertical portion, and a manually operated latch release adjustably mounted on at least one of said hurdle bar supports connected to said latch for adjusting the latch between a disengaged position free of a retainer and a position freeing the latch for registering with a retainer.

4. The hurdle of claim 3 wherein said vertical portions have bores therein comprising said latch retainers, distributed at preselected distances from the bottom thereof and said latch includes a latch pin mounted on the lower end of each of said bar support, said latch pin cooperating with a bore to hold the bar support at a preselected height.

5. An adjustable height track hurdle comprising:

a base including a pair of spaced apart, hollow, tubular L-shaped standards, and a cross piece connecting the standards;

an elongate hurdle bar;

a pair of hurdle bar supports joined to said hurdle bar adjacent the ends thereof telescopically mounted on said standards for permitting adjustment of the height of said hurdle bar;

pull-over weight-setting mechanism for maintaining a constant predetermined pull-over weight at the top of said hurdle bar, said mechanism comprising a weight slidably located in the horizontal portion of each standard, and weight-positioning means operable to shift said weights as the height of the hurdle bar is changed to maintain a predetermined pull-over weight as measured on said hurdle bar;

said weight-positioning means including cable-retaining means and a cable having one end thereof attached to said weight, the other end of said cable being attached to said cable-retaining means, and a cable-adjustment mechanism operatively interposed between said cable-retaining means and bar support to adjust the position of said weight for a given bar support position.

6. The hurdle of claim 5 which includes height-setting means for selectively fixing the height of said hurdle bar above a atrack, said setting means including a latch mechanism mounted on each of said bar supports, said latch mechanism being operable to fix the height of said hurdle bar relative to said standards, and a latch release located adjacent and under said hurdle bar operable to selectively release and engage said latch mechanism.

7. An adjustable height track hurdle comprising:

a base including a pair of spaced apart hollow, tubular standards, each standard having a substantially vertical portion joined at a right angle to a substantially horizontal portion, each vertical portion having bores distributed therein at preselected distances from the bottom thereof, and a cross piece connecting said standards;

a hurdle bar;

a pair of hurdle bar supports joined to the ends of the hurdle bar telescopically mounted on said vertical portions permitting adjustment of the height of said hurdle bar;

height-setting means for selectively fixing the height of said hurdle bar above a track, said setting means including a latch mechanism, having a latch pin, mounted on each of said bar supports, said latch pin cooperating with a bore in said vertical portion to hold the bar support at a preselected height, a latch release pivotally mounted on said bar support adjacent said hurdle bar, and a connecting rod extending between said latch pin and said release lever, said mechanism being manually operable to selectively shift said latch pin between a disengaged position free of a bore and a position enabling said latch pin to register with a bore;

a constant pull-over weight mechansim for maintaining a constant, predetermined pull-over weight at the top of said hurdle bar regardless of hurdle bar height, said weight mechanism comprising a weight slidably located in each horizontal portion, spring biasing means for urging said weights toward an end of said horizontal portions, and weight-positioning means operable to position the weight in said horizontal portion as said hurdle bar height is changed, said weight-positioning means including a cable having one end thereof operatively affixed to said weight, cable-retaining means attached to the other end of said cable, and a set of pulleys disposed in each standard, said cable being trained over said pulleys; and a cable-adjustment mechanism operatively interposed between said cable-retaining means and said bar support to adjust the position of said weight for a given bar support position thereby to adjust the pull-over for a given hurdle bar height.

* * * * *